US005890528A

United States Patent [19]

McDonald

[11] Patent Number: 5,890,528

[45] Date of Patent: Apr. 6, 1999

[54] ROLL-UP BLIND AND CORD GUIDE UNIT

[75] Inventor: Peter Ronald McDonald, Aspendale, Australia

[73] Assignee: Gale Pacific Pty. Ltd., Victoria, Australia

[21] Appl. No.: 950,386

[22] Filed: Oct. 14, 1997

[30] Foreign Application Priority Data

Oct. 11, 1996 [AU] Australia ..... P02904

[51] Int. Cl.[6] ..... A47G 5/02

[52] U.S. Cl. ..... 160/243; 160/178.2 R

[58] Field of Search ..... 160/243, 84.01, 160/84.04, 84.05, 168.1 R, 173 R, 176.1 R, 178.2 R

[56] References Cited

U.S. PATENT DOCUMENTS

| | | | |
|---|---|---|---|
| 2,821,247 | 1/1958 | Satosky | 160/176.1 R |
| 4,413,664 | 11/1983 | Istha | 160/178.2 R |
| 4,443,915 | 4/1984 | Niemeyer | 160/178.2 R X |
| 4,603,725 | 8/1986 | Knight | 160/243 |
| 4,919,186 | 4/1990 | Uecker et al. | 160/84.01 X |
| 5,348,068 | 9/1994 | Elsenheimer et al. | 160/176.1 R |

*Primary Examiner*—David M. Purol
*Attorney, Agent, or Firm*—Ladas & Parry

[57] ABSTRACT

A cord guide unit 2 for a roll-up blind 4 having a top rail 6 in the form of an extruded section. The guide unit 2 is moulded from a plastics material and is dimensioned to frictionally fit within an end 20 of the top rail extruded section 6. The guide unit 2 includes side walls 23, 24 which are joined by two intermediate sections which provide upper surfaces joined to end surfaces by curved surface portions for guiding the travel of a cord for operating the blind through 90°. An aperture 52 is provided between the two intermediate sections for the passage of a loop of the cord. An end flange 22, which provides a closure for the end 20 of rail 6, is spaced from one of the intermediate sections thereby providing another aperture 54 within which is mounted a pivotal cord wedging element 56. A draw section of the cord passes through aperture 54 and can be selectively wedged against an end surface of the adjacent intermediate section by wedging element 56 to hold the blind in a rolled-up position. The cord guide unit eliminates pulleys for the cord and is inexpensive to manufacture.

19 Claims, 2 Drawing Sheets

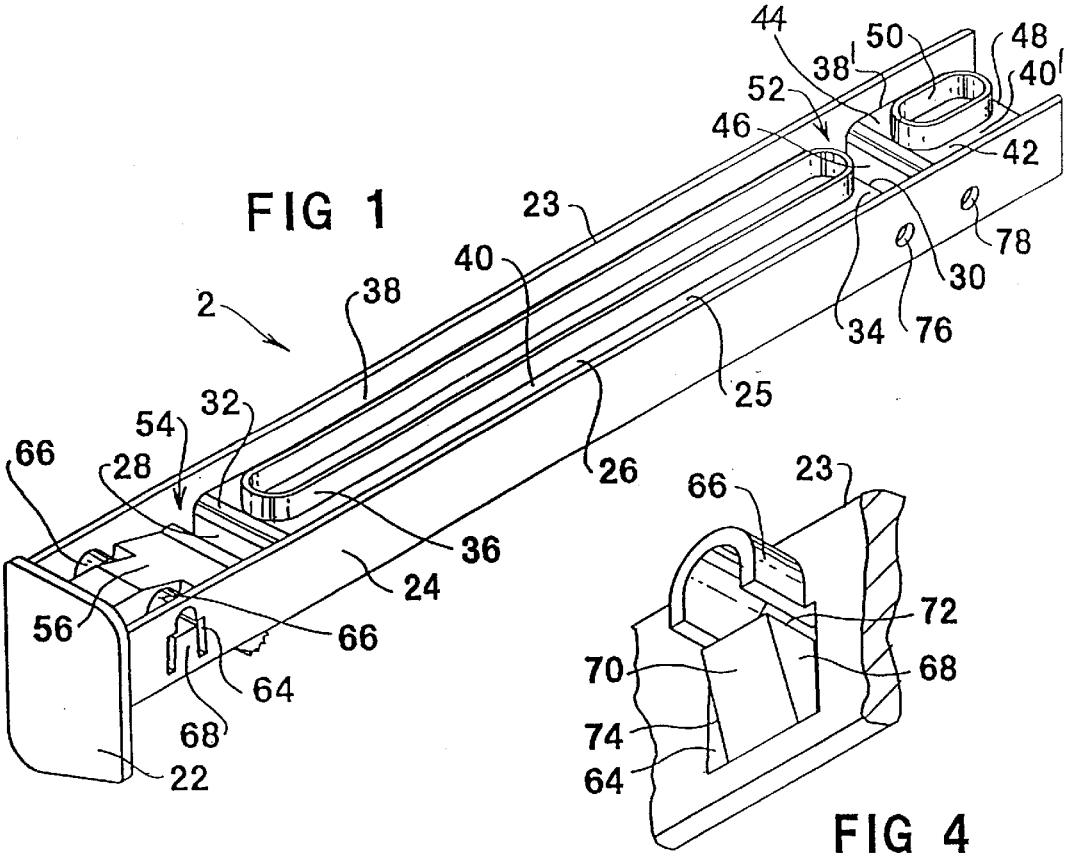
FIG 1
FIG 4
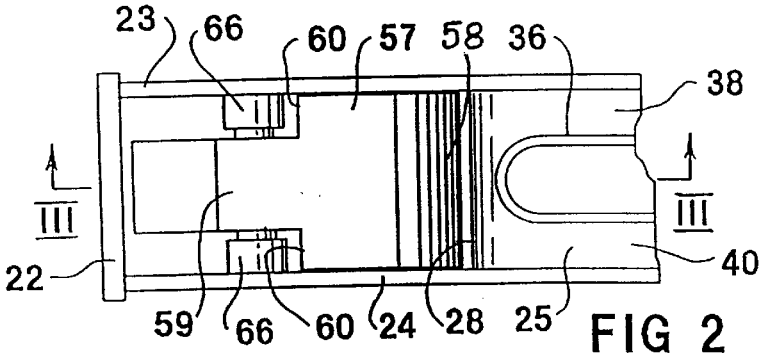
FIG 2
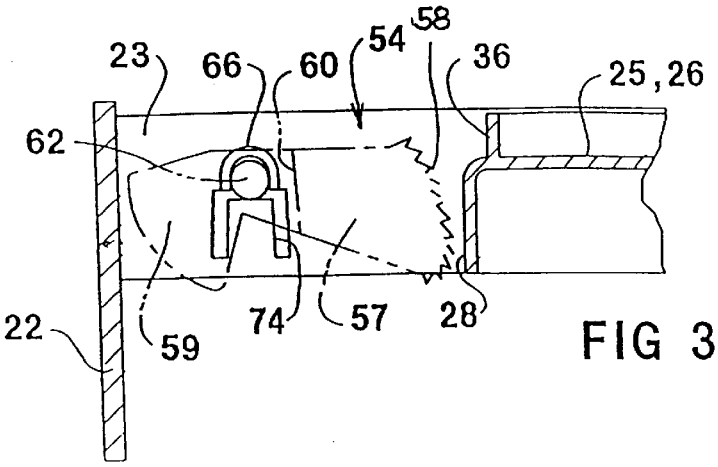
FIG 3

ROLL-UP BLIND AND CORD GUIDE UNIT

TECHNICAL FIELD

The present invention relates to a cord guide unit for a roll-up blind or awning or the like having a top rail in the form of an extruded section. The invention also includes a roll-up blind, awning or the like incorporating the cord guide unit. Hereinafter the term "blind" is to be understood as encompassing a roll-up awning or like fitting.

BACKGROUND

Roll-up blinds include a length of cord which is arranged to form a loop around each end of the blind and to include a draw section which is normally manually pulled to simultaneously shorten the two loops and thus cause the blind to roll up. It is known for roll-up blinds employing such a cord arrangement to include pulleys to guide the motion and direction of travel of the cord. However the known pulley arrangements are subject to many problems, for example, a pulley formed of a plastics material may wear too rapidly around its axle and thus become subject to jamming, or a pulley formed of metal may corrode, particularly given metal pulleys are usually used on blinds for use on the exterior of buildings where they are normally exposed to the weather. Pulleys are also a relatively expensive component in roll-up blinds.

SUMMARY OF THE INVENTION

An object of the present invention is to provide a cord guide unit for a roll-up blind for alleviating the above mentioned problems.

According to the Invention there is provided a cord guide unit for a roll-up blind having a top rail in the form of an extruded section, wherein the guide unit is dimensioned to frictionally fit within an open end of the top rail section, and wherein the guide unit includes a surface over which a cord for rolling up a blind slides, the surface being adapted to guide the cord.

Preferably the guide unit is formed of a plastics material, for example by moulding, and provides a closure for an end of the top rail section of a blind.

A guide unit according to the invention does not employ pulleys and thus eliminates the problems associated with them. In fact a cord guide unit according to the invention may Include at most, only two parts, the first being a plastics moulding providing a guiding surface as described above and the second a cord wedging element (to be described herein below). The cord guide unit, in use, is substantially wholly contained in the top rail section of a blind and is thus concealed so as not to detract from the visual appearance of the blind. Indeed, in providing a closure for the top rail section, the guide unit can provide a neat finish for the ends of the top rail. Also, when employed in blinds for use externally of a building, the guide units are not substantially exposed to the weather and are thus not subject to the deterioration such exposure can cause. Generally, a guide unit according to the Invention is also cheaper to manufacture than pulleys.

Preferably the guiding surface of the cord guide unit has a top portion that extends substantially horizontally and another portion that extends substantially vertically in use of the guide, whereby the two portions smoothly guide the direction of travel of a cord through substantially 90°. The terms "top", "horizontal", "vertical", "upper", "inner", "outer" and the like are to be construed with reference to the orientation of a guide unit in a blind, and a blind as such, when in their normal use orientations. They are not to be taken as requiring that a guide unit or blind actually be in that orientation. In providing a horizontal and vertical surface portion, a guide unit according to the Invention provides for a change in direction of the cord, for example from a vertical loop to a horizontal length within the top rail across the blind from one guide unit in one end to another guide unit in the other end of the top rail.

Preferably the cord guiding surface includes a further portion that extends, in use of the guide, substantially vertically. This feature allows the one guide unit to provide for two changes in direction of a cord, for example a vertical loop and the draw section can depend from the one guide unit. It will be appreciated that the vertical portions of the cord guiding surface will be spaced apart and joined by the top horizontal portion and their spacing will determine the distance between the draw section and the adjacent loop for the cord of a blind.

Preferably, the guide unit includes a second guiding surface, which also has a vertical portion at each end, and wherein a vertical surface of each of the two guiding surfaces form facing walls of an aperture through the guide unit. This feature facilitates use of the guide unit at either end of the top rail, that is, the aperture provides for passage of the cord to form one loop and for the cord to then pass over one guide surface to form the draw section (as is required for one side of the blind), or to pass over the second guide surface and across the top rail to the second guide unit (as is required for the other side of the blind).

Preferably the top portion of the one or two guiding surfaces include one or a plurality of channels for separating and guiding substantially parallel travel of adjacent portions of a cord. It will be appreciated that at least for the guide unit providing for a loop and a draw section of the cord, two lengths of the cord will be required to run substantially parallel to each other across the top surface, that is, one end from the draw section will extend to one of the rolling up loops and the other end from the draw section will extend to the other rolling up loop.

Preferably the guide unit includes two apertures, one being adjacent an inner end of the unit and having walls defined by vertical portions of two guiding surfaces (as described above) and the second adjacent an outer end of the guide unit. Preferably the second aperture includes an element for wedging a cord between a surface of the element and a facing vertical portion of the cord guiding surface. Preferably the cord wedging surface of the element is serrated such that a cord brought into contact therewith and on which an upwards force exists (due to the weight force of a rolled up blind) will cause the element to pivot such that the cord becomes wedged between the serrated surface and the facing vertical portion of the cord guiding surface. Preferably a cord guide unit according to the invention provides a snap fitting for the cord wedging element to be pivotally mounted in the second aperture. Preferably this snap fitting is such that it provides a restoring bias on the element should it, in use of the guide, pivot downwardly beyond its normal resting position.

The invention also provides a roll-up blind having a top rail in the form of an extruded section and a guide unit as above described In each end of the rail for the cord of the blind.

An embodiment of the invention will now be described, by way of non-limiting example only, with reference to the accompanying drawings.

BRIEF DESCRIPTION OF DRAWINGS

FIG. 1 is a perspective view of a guide unit according to an embodiment of the invention, FIG. 2 is a top plan view of portion of the guide unit of FIG. 1, FIG. 3 is a section along line III—III of FIG. 2, FIG. 4 shows a detail of the guide unit for mounting a cord wedging element.

DESCRIPTION OF PREFERRED EMBODIMENT

Figure 5:
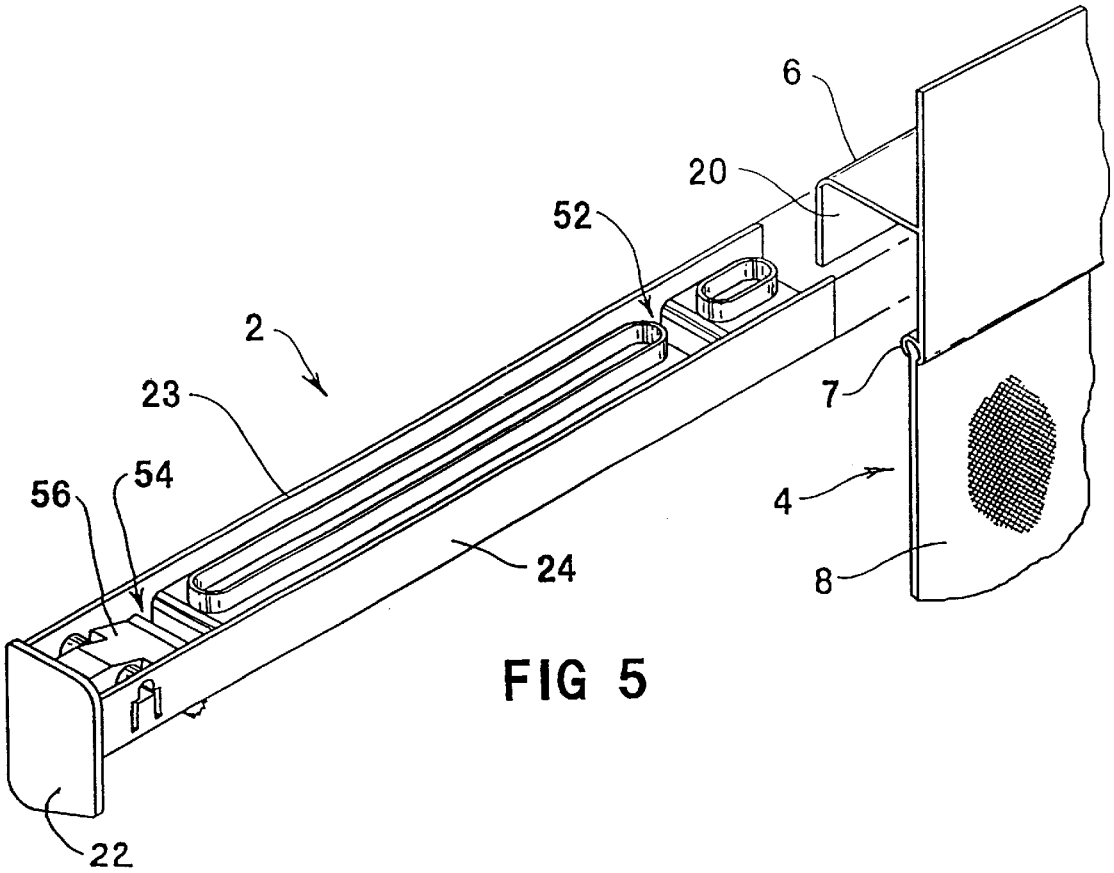
FIG. 5 is an exploded perspective view of the guide unit and an end portion of the top rail of a roll-up blind, and FIG. 6 schematically shows a draw cord arrangement for a roll-up blind.
Figure 6:
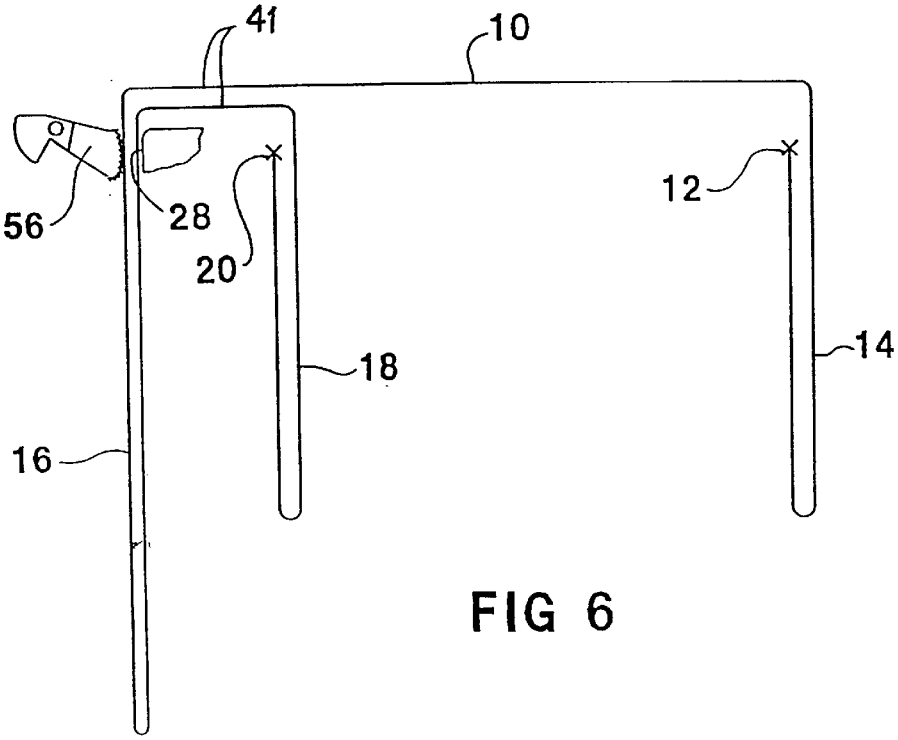

A cord guide unit 2 according to the invention is for use with a roll-up blind 4 having a top rail 6 in the form of an extruded section (see FIG. 5). The blind 4 comprises a fabric 8 depending from a lower channel 7 in rail section 6, which section is open downwardly. The blind 4 includes a bottom rail (not shown) and is operated by a cord 10 which is attached to the top rail 6/guide unit 2 at a fixed point 12 (see FIG. 6) near one side of the blind and extends downwardly to form a first loop 14, it then extends inside and across the top rail 6 to the guide unit 2 in the other end of the top rail 6 and then downwardly to form a draw section 16. The cord 10 then extends a short distance inwardly of the end of the blind and downwardly to form a second loop 18, which terminates at a fixed point 20 at the top rail/guide unit. When draw section 16 is pulled downwardly, the two loops 14 and 18 are shortened which causes the blind to roll up on its bottom rail.

The fabric 8 for the blind 4 may be a knitted shade cloth which Is ultra-violet stabilized and effective to block up to 90% UV rays and the top or head rail 6 may be an extruded aluminium section which Is powder coated for corrosion resistance. It may also be colour coordinated with the fabric 8. Other materials for the blind or the rail, and sectional shapes for the rail other than that illustrated, may also be used.

The guide unit 2 is dimensioned to frictionally fit within an open end 20 of top rail 6 (see FIG. 5) and may include an end flange 22 which provides a closure for the end 20, thus conferring a neat finish for the end of the rail 6. The guide unit includes two substantially parallel side walls 23, 24 which extend from end flange 22 and between which an intermediate section 25 provides a surface over which the cord 10 slides and which is adapted to guide the cord.

The intermediate section 25 has an upper surface portion 26, which is located a small distance below the tops of walls 23 and 24 and which extends substantially horizontally in use of the blind, and end surface portions 28 and 30, which depend from each end of the upper surface portion 26 and are smoothly joined thereto by curved surface portions 32, 34 respectively. The intermediate section 25 may Include an annular wall 36 on the upper surface portion 26. This wall in conjunction with side walls 23 and 24 provides two channels 38, 40 for separating and guiding substantially parallel travel of adjacent lengths of cord 10, as will occur for the cord lengths 41 between draw sections 16 and second loop 18 (see FIG. 6).

The guide unit 2 also includes an additional intermediate section 42 joining side walls 23, 24 providing a second guiding surface which is located inwardly of the guide unit with respect to the first intermediate section 25. The second guiding surface, like the first, includes an upper surface portion 44 and depending end surface portions 46, 48 joined thereto by smoothly curved surface portions. It also Includes an annular wall 50 which in conjunction with side walls 23, 24 provides two channels 38', 40', which are in alignment with channels 38, 40.

The guide unit includes two apertures, the first 52 being at an inner position and defined by the facing end surface portions 30 and 46 of the first and the additional Intermediate sections 25 and 42 and the facing inside surfaces of side walls 23 and 24. The second aperture 54 is defined by the inner face of end flange 22, facing end surface portion 28 and facing inside surfaces of side walls 23 and 24. At one end of the top rail 6, the cord 10 extends through the first aperture 52 of a guide unit in the rail to form the first loop 14, and at the other end of the top rail 6, the cord 10 extends through the first aperture 52 to form the second loop 18 and through the second aperture 54 to form the draw section 16. It will be appreciated that the distance of end surface portion 30 of the first intermediate section 25 from end flange 22 determines the location of each loop 14, 18 inwardly of the adjacent edge of the blind.

The second aperture 54 includes a wedging element 56 for wedging cord 10 between a surface 58 of the wedging element and the end surface portion 28 of the Intermediate section 25 for locking the cord in position when the blind is rolled up to prevent it unrolling due to the weight of its bottom rail.

The cord wedging element 56 includes a first wedge shaped section 57 providing the surface 58 and a second section 59. The width of the first section is slightly less than the distance between the Inner facing surfaces of the side walls 23, 24 of guide unit 2 such that it is freely movable therebetween. Second section 59 is of lesser width than first section 57 such that a shoulder 60 is provided on each side of the element 56. A stub shaft 62 extends outwardly from each side of second section 59. The stub shafts 62 are for pivotally mounting the cord wedging element 56 in aperture 54, as will be described below. The first portion 57 is larger in size and thus heavier than second section 59 and the stub shafts 62 are located relative to each section 57, 59 such that the element 56 is biased to rotate In a clock-wise direction (with reference to FIG. 3) about stub shafts 62. The wedging surface 58 of the cord wedging element 56 is also serrated to grip a cord 10 when the cord is manually forced against it.

The portion of each side wall 23, 24 defining the aperture 54 includes a structure for snap fitting a cord wedging element 56 in the aperture 54. This structure includes an aperture 64 (see FIG. 4) having an inwardly directed semi-circular flange 66 around an upper end and a tab 68 extending upwardly from a lower end. The tab 68 is wedge shaped such that an inner facing surface 70 thereof tapers inwardly of wall 23 to a top surface 72 which is opposed to the inner surface of semi-circular flange 66. The tab 68 is resiliently deformable outwardly of wall 23 to provide for a snap-fitting of the cord wedging element 56 in aperture 54. Thus a wedging element 56 may be mounted for pivotal movement within a guide unit 2 by positioning it below the aperture 54 and pressing it upwardly such that the ends of stub shafts 62 cam the opposed tabs 68 outwardly until the shafts 62 pass the tabs and seat within the flanges 66. The tabs 68 snap return to their undeformed positions when passed by the stub shafts 62 such that top surface 72 of each tab retains the element 56 in position for pivotal movement within aperture 54 about the stub shafts 62.

The invention includes alternative structures for mounting a cord wedging element 56 in the aperture 54. Thus, for example, a semi-circular flange, like flange 66, but which is concave upwardly (that is, inverted relative to the position shown for flange 66 in FIG. 4) may be provided extending inwardly from each side wall 23, 24. These flanges are for receiving the stub shafts 62 of a cord wedging element 56, which element may be placed in position downwardly through the aperture 54. It will be appreciated that with this arrangement, the cord wedging element is not snap-fitted into position. Appropriately placed stops may be required on the walls 23,24 to define a pivotal resting position for the cord wedging element. Alternatively, the weight distribution of the cord wedging element may be arranged to provide it with a resting position.

The bias on an element 56 due to its weight distribution causes it to have a resting position which is determined by the shoulders 60 lying in contact with an adjacent side edge 74 of the tabs 68 (see FIG. 3). The width of first section 57 of a cord wedging element 56 is dimensioned relative to the tabs 68 for the shoulders 60 to only slightly overlap the edges 74 so that they can cam over these edges and ride on surfaces 70, should a cord wedging element 56 be rotated past its resting position. This develops a restorative spring bias, due to the resilience of the tabs 68, which returns the cord wedging element to its resting position.

In the resting position of the cord wedging element 56 the wedging surface 58 lies clear of the facing end surface portion 28 for the draw section 16 of a cord 10 to be freely pulled downwardly between them to enable a blind 4 to be rolled up. When the blind has been rolled up to a desired position, the operator moves the draw section 16 sideways to bring the cord into contact with the serrated surface 58 of wedging element 56 and releases the pulling tension. The upwards tension on draw section 16 due to the weight of the blind then causes the cord wedging element 56 to pivot upwardly which moves Its serrated surface 58 closer to surface portion 28 thus wedging the cord 10 between the two surfaces and preventing the blind unrolling. To release the cord lock, an operator pulls on draw section 10 to rotate element 56 downwardly and then moves the cord sideways out of contact with surface 58, which releases the lock and allows space between the surfaces 58 and 28 for the draw section 16 to freely move upwardly therethrough.

The guide unit 2 includes two holes 76, 78 extending through wall 24 on either side of aperture 52. These holes are for fixing a cord 10 to a unit 2 at a position referenced 12 or 20 shown In FIG. 6. The cord 10 is fixed at each of these positions by a knot in its end, which bears against the Inside surface of wall 24, the cord passing through a hole 76 or 78 and through an aligned hole in the rear wall of the rail section 6 and then extending to form a loop 14 or 18.

A cord unit 2 according to the invention is preferably made of a plastics material and moulded. Depending on the symmetry of the rail section 6, only one or at most two forms of a guide unit need to be moulded for use with the one rail section. Thus, if the rail section is symmetrical, only the one form of unit is needed because the end flange 22 will be symmetrical. However if the rail 6 is non-symmetrical, for example as In the FIG. 5 illustration, a left hand and a right hand form of the unit will need to be made. The only difference between these units will be the orientation of the end flange 22, with one being a mirror image of the other. The cord wedging element 56 is also preferably moulded from the same plastics material as a unit 2. Thus, at most, only three components are required for the cord control mechanism of a blind 4. These are a left and a right hand form of a guide unit 2 and a cord wedging element 56. It will also be appreciated that the cord mechanism is fully enclosed in the top rail section 6 and contains no moving parts such as pulleys or the like which can corrode and cause the blind mechanism to seize.

The invention described herein is susceptible to variations, modifications and/or additions other than those specifically described and it is to be understood that the invention includes all such variations, modifications and/or additions which fall within the spirit and scope of the following claims.

The claims defining the invention are as follows:

1. A cord guide unit for assembly with a top rail of a cord operated roll-up blind, the top rail being an extruded section, said cord guide unit comprising an elongate body for fitment within the extruded section of the top rail of the roll-up blind, said elongate body being defined by side walls joined by at least one intermediate section, said intermediate section providing a fixed surface on which a cord of the blind is slidable, said fixed surface being shaped to guide the cord through substantially 90° between a first direction of travel along the elongate body and a second direction of travel transverse thereto and wherein said surface extends in each said direction.

2. A cord guide unit as claimed in claim 1 wherein the intermediate section provides an upper surface portion which defines the direction of travel along the elongate body and an end surface portion which defines the transverse direction of travel, wherein the upper and the end surface portions are joined by a curved surface portion for smoothly guiding the direction of travel of the cord through substantially 90°.

3. A cord guide unit as claimed in claim 1 wherein the intermediate section provides an upper surface portion and opposite end surface portions respectively joined to the upper surface portion by curved surface portions for smoothly guiding-the directional travel of the cord through substantially 90° at each end of the Intermediate section.

4. A cord guide unit as claimed in claim 3 wherein the side walls of the elongate body are joined by an additional intermediate section which is spaced apart from said at least one intermediate section along the length of the elongate body thereby defining an aperture through the body, wherein the additional intermediate section also provides a surface over which the cord slides and which is shaped to guide the cord through substantially 90° between the first direction of travel along the elongate body and the second direction of travel transverse thereto.

5. A cord guide unit as claimed in claim 4 wherein the additional intermediate section provides an upper surface portion which defines the first direction of travel along the elongate body and an end surface portion which defines the transverse direction of travel, wherein said upper and said end surface portions are joined by a curved surface portion for smoothly guiding travel of the cord through substantially 90°, wherein said end surface portion of the additional intermediate section faces an end surface portion of said at least one intermediate section thereby defining said aperture.

6. A cord guide unit as claimed in claim 5 wherein the upper surface portions of said at least one and said additional intermediate sections are co-planar and wherein the side walls extend above said upper surface portions thereby providing a channel for the cord.

7. A cord guide unit as claimed in claim 6 wherein the upper surface portion of each intermediate section includes an upstanding wall thereby providing parallel channels for separating substantially parallel travel of adjacent portions of the cord.

8. A cord guide unit as claimed in claim 5, wherein the side walls extend beyond said at least one intermediate section away from the additional intermediate section, and wherein the extended side walls include mounting for pivotally mounting a wedging element between the side walls.

9. A cord guide unit as claimed in claim 8, wherein said wedging element defines a surface which faces the end surface portion of said at least one intermediate section, said surface of the wedging element being movable upon pivotal movement of the wedging element towards and away from said facing end surface portion of the intermediate section for wedging the cord of the blind therebetween, said mounting means including a stop surface defining a resting position for the wedging element in which the cord of the blind can freely pass between said surface of the wedging element and the facing end surface portion of said at least one intermediate section.

10. A cord guide unit as claimed in claim 9, wherein said surface of the wedging element includes means engageable by the cord for pivoting the wedging element upwardly into a cord wedging position.

11. A cord guide unit as claimed in claim 10, wherein the means for pivoting the wedging element comprises serrations on said surface of the wedging element.

12. A cord guide unit as claimed in claim 10 wherein the mounting means provides for a snap fitting of the wedging element between the side walls of the elongate body.

13. A cord guide unit as claimed in claim 12 wherein the mounting means includes a resilient structure for providing said stop surface and a bias on the wedging element when the wedging element pivots past the stop surface, whereby the bias returns the wedging element to its resting position.

14. A cord guide unit as claimed in claim 8, wherein the extruded top rail includes an end flange extending across the extended side walls of the top rail for providing a closure for the extruded top rail.

15. A cord guide unit as claimed in claim 14 wherein the cord guide unit is integrally moulded from a plastics material.

16. A roll-up blind comprising a top rail including an extruded section having opposite ends, a sheet of fabric depending from the top rail, a cord for operating a blind associated with the top rail and the sheet of fabric, and a cord guide unit assembled within each end of the extruded section of the top rail, each cord guide unit comprising an elongate body defined by side walls joined by a first and a second intermediate section, each intermediate section having a fixed surface on which the cord is slidable and which is shaped to guide the cord through substantially 90° between a first direction of travel along the elongate body and a second direction of travel transverse to the elongate body, said first and second intermediate sections defining an aperture therebetween through which a looped portion of the cord passes in said transverse direction, each said looped portion of the cord in said cord guide units being associated with the sheet of fabric, the cord including a further portion which depends from one of said cord guide units and which is manipulable for reducing or increasing the size of said looped portions for, respectively, rolling up or unrolling the sheet of fabric.

17. A roll-up blind as claimed in claim 16, wherein said one of said cord guide units from which said further portion of the cord depends includes a wedging element pivotally mounted between the side walls thereof, said wedging element including a surface which faces and moves towards and away from a portion of said fixed surface of one of said intermediate sections upon pivotal movement of the wedging element, said further portion of the cord passing between said surface of the wedging element and said portion of the fixed surface of the intermediate section and being selectively wedgable therebetween for retaining the blind in a rolled-up condition.

18. A roll-up blind as claimed in claim 17, wherein the wedging element is moulded from a plastics material.

19. A roll-up blind claimed in claim 16, wherein said cord guide units are moulded from a plastics material and are frictionally retained in the extruded section of the top rail.

* * * * *